US006554677B2

(12) United States Patent
Leemon

(10) Patent No.: US 6,554,677 B2
(45) Date of Patent: Apr. 29, 2003

(54) FLEXIBLE FOAM BUILDING KIT WITH CONNECTORS FOR CONSTRUCTING CHILDREN'S PLAY STRUCTURES

(76) Inventor: Arnold Anton Leemon, 2660 Mandale Ter., West Bloomfield, MI (US) 48324

( * ) Notice: Subject to any disclaimer, the term of this patent is extended or adjusted under 35 U.S.C. 154(b) by 75 days.

(21) Appl. No.: 09/948,046

(22) Filed: Sep. 7, 2001

(65) Prior Publication Data

US 2003/0049992 A1 Mar. 13, 2003

(51) Int. Cl.[7] ..... A63H 33/12
(52) U.S. Cl. ..... 446/122; 446/124
(58) Field of Search ..... 446/119, 120, 446/122, 124, 125, 126, 85; 206/151, 153, 457

(56) References Cited

U.S. PATENT DOCUMENTS 4,708,684 A * 11/1987 Chen ..... 446/127
4,764,143 A * 8/1988 Gat et al. ..... 446/102
5,735,562 A * 4/1998 Borg ..... 206/151
5,916,006 A * 6/1999 Ganson ..... 446/85
6,132,276 A * 10/2000 Leemon ..... 441/129
6,402,581 B1 * 6/2002 Podgaiz ..... 446/107
6,478,649 B1 * 11/2002 Hoback ..... 446/85

* cited by examiner

*Primary Examiner*—Jacob K. Ackun
*Assistant Examiner*—Faye Francis
(74) *Attorney, Agent, or Firm*—Bill C Panagos

(57) ABSTRACT

A building kit for making various play structures for children, comprising at least a first set of foam tubes of a predetermined length; each said foam tube having opposing first and second ends in spaced apart relation to each other and an axial extending opening in each end extending at least partially along the length of each foam tube, at least one first connector having spaced apart apertures for receiving one or more closed cell foam tubes in a friction fit relationship; and at least one angled connector having two legs joined at an apex in co planar angled relationship to each other; said legs adapted to be inserted into said apertures in said opposing ends of said foam tubes in a friction fit relationship.

13 Claims, 4 Drawing Sheets

FLEXIBLE FOAM BUILDING KIT WITH CONNECTORS FOR CONSTRUCTING CHILDREN'S PLAY STRUCTURES

BACKGROUND OF THE INVENTION

1. Field of the Invention

The present invention is directed to a foam building kit to construct children's play structures.

The present invention is further directed to a kit of flexible foam tubes and connectors to allow a child to construct a multitude of play structures into which he/she may enter, yet be fully visible to a supervising adult.

The present invention is further directed to a kit comprised of flexible, lightweight and durable polyethylene foam material and a series of connecting means to allow a child to construct a multitude of play structures, disassemble the structure, and create new structures.

These and other objects will become apparent to those of ordinary skill in the art upon a reading of the specification.

2. Description of the Related Art

Children's building kits are known in the art. Applicant is aware of Kindertimber, a kit reminiscent of Lincoln log building sets. The Kindertimber product is constructed of foam materials, such as polythetylene foam, and is configured such that each log in the kit interlocks with another in pre-cut areas on the ends of the logs, or at their centers. Thus, the child stacks the logs as one would stack Lincoln logs to erect a structure.

Kindertimber differs from the present invention in that there are no gaps in between the stack logs so that a supervising adult cannot see into the structure to see what the child is doing. In addition, Kindertimber does not employ the connectors or spacers of the present invention, and does not use the same polyethylene foam material.

Leemon, U.S. Pat. No. 6,123,276 discloses a lightweight connector with buoyant members. The connector is in the form of a substantially flexible body having a plurality of spaced apart apertures for receiving one or more buoyant members in a friction fit relationship. By adjusting the location of the connector relative to the buoyant members, the buoyancy of the resulting flotation apparatus can be adjusted.

Leemon teaches that a variety of flotation apparatus' are possible using the connectors and the flotation logs. However, there is no showing in Leemon '276 to use the connectors show therein in a child's building kit to join various members into a structure wherein there is a spaced apart relation between each of the constituent log members.

SUMMARY OF THE INVENTION

The present invention is directed to a building kit for making various play structures for children. The kit is comprised of at least a first set of foam tubes of a predetermined length; each said foam tube having opposing first and second ends in spaced apart relation to each other and an axial extending opening in each end extending at least partially along the length of each foam tube; at least one first connector having spaced apart apertures for receiving one or more foam tubes in a friction fit relationship; and at least one angled connector having two legs joined at an apex in co-planar angled relationship to each other; said legs adapted to be inserted into said apertures in said opposing ends of said foam tubes in a friction fit relationship.

The present invention is further directed to a kit for constructing children's play buildings, comprised of a plurality of sets of durable lightweight flexible foam tubes having a length, a width, and first and second opposing ends in spaced apart relation to each other to define a body, said length being greater than said width; each said foam tube in each said set being uniform in length; each said flexible foam tube having a passage extending axially through the length of the foam tube, at least one first connector for use in association with a flexible tube member, said first connector comprises a flexible body including a first ring member having an aperture and a second member having an aperture, at least one of said apertures including one inwardly extending fin to define the inner diameter of said ring member to receive said foam tube in a friction fit; and at least one angled connector for use in association with connecting said flexible tubes, said angled connector comprised of two legs at opposed angled relation to each other, each said leg insertable in said passage at either end of said flexible foam tube to provide a friction fit to connect the tubes together axially; and at least one spacer interposable between said foam tubes.

DETAILED DESCRIPTION OF THE PREFERRED EMBODIMENT

Figure 1:
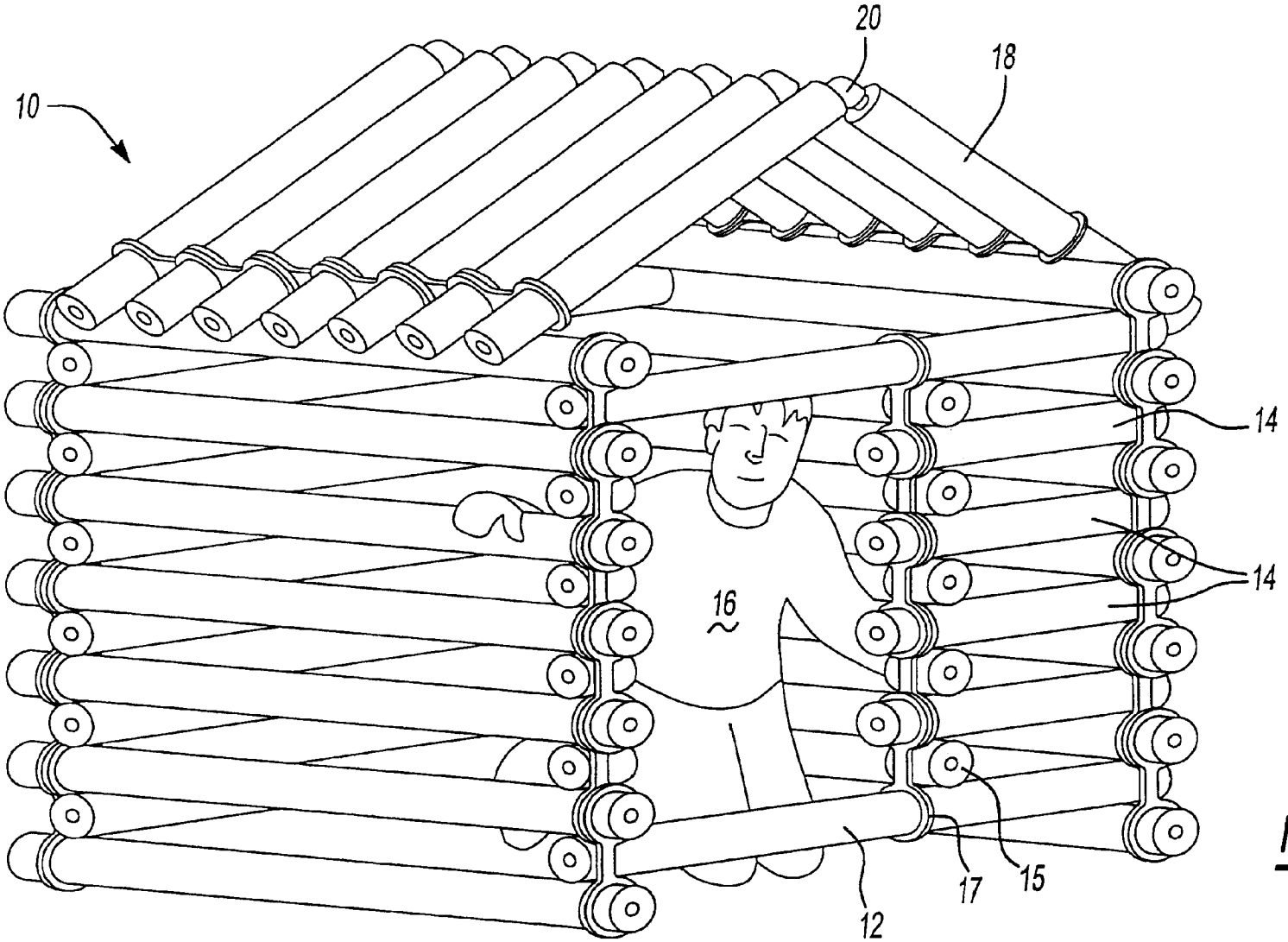
FIG. 1 is a three dimensional perspective of one structure that is possible with the kit of the present invention.
Figure 3A:
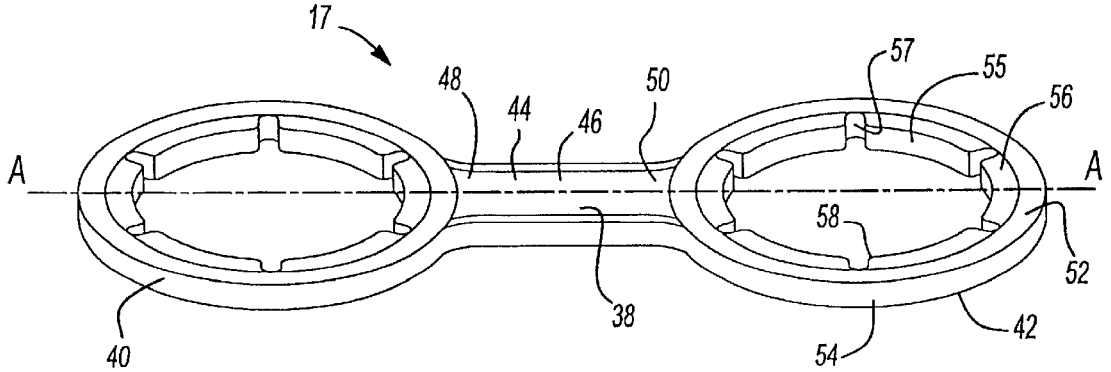
FIG. 3A is a top plan view of the first connector of the present invention showing its structure.

Turning now to the drawings wherein like numerals refer to like numbers, and particularly to FIG. 1, there is shown therein a structure 10, made of lengths of individual tubes 12. The tubes come in a number of different lengths, and each tube of the same length comprises a set 14 of, but not limited to, tubes. The tubes are separated from each other by means of spacer logs 15, and held together in a friction fit by the first connector 17, as seen in FIGS. 3A, B, C, and D, which will be discussed in greater detailed relative to the discussion of those figures. Since the logs are held apart from each other, a child 16 may be seen through the walls of the structure, so that the supervising adult is always assured that the child is safe in his/her play. Along the roof 18 of the structure are angled connectors 20, which are angled to provide the pitch of the roof. Each end 22, and 24 of the angled connector is radiused for safety and insertable into axial opening 26 in the foam logs, to provide a friction fit and hold the foam logs at the desired angled position. These angled connectors will be discussed in greater detail in relation to FIG. 4 below.

Figure 2:
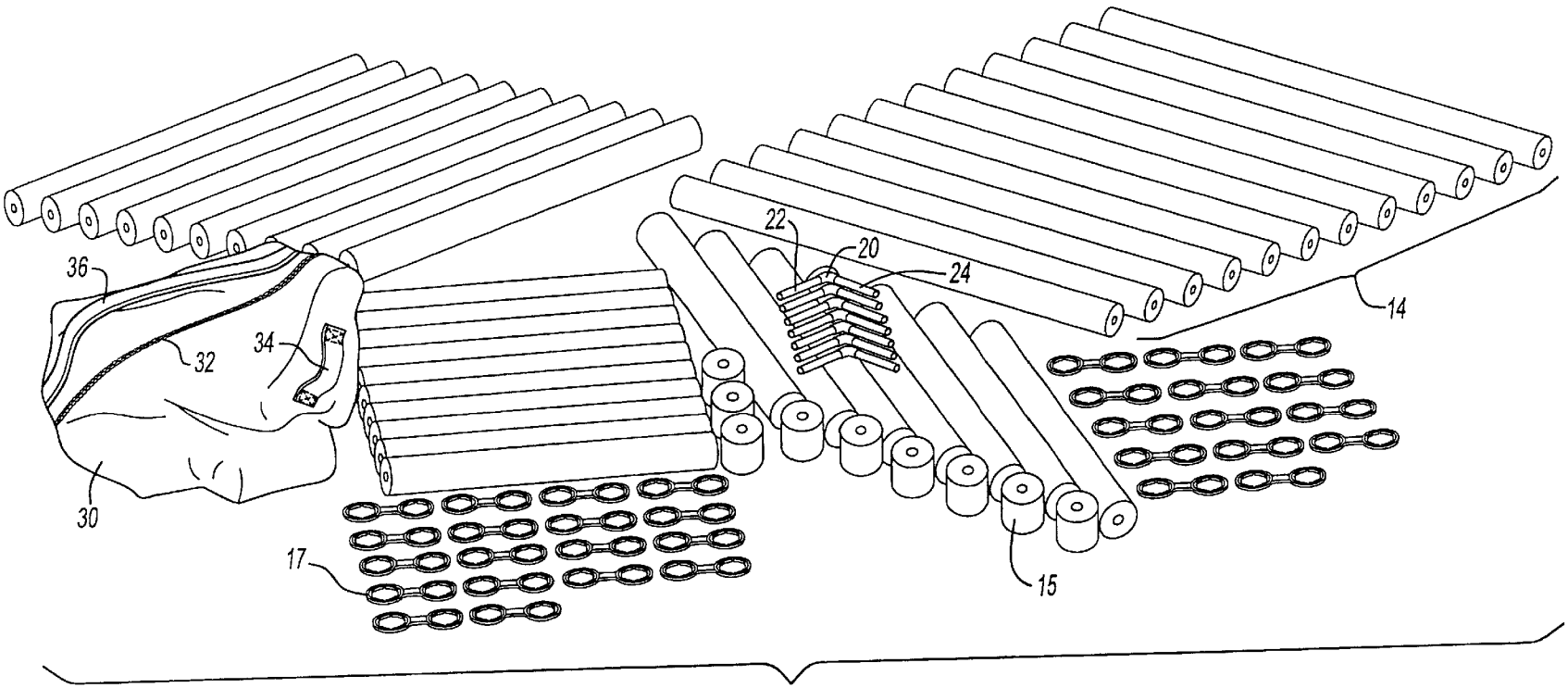
FIG. 2 shows the various sets of flexible foam tubes, with the spacers and connectors.

Turning now to FIG. 2, there is shown therein one representative building kit. The kit is comprised of various sets of logs of different colors and lengths. It will be noted that a set of logs is defined as a group of logs of the same length and diameter as all the other members of that set. Thus, it can be seen that there are at least, but not limited to, four sets of logs, including the spacers. Note also that each kit has a variety of first connectors as well as a number of angled connectors. A carrying case 30 is provided to store the kit when not in use. The carrying case is constructed of a lightweight nylon type material that is equipped with a zipper or other fastener 32, handles 34, and a carrying strap 36. Thus, it can be seen that be means of the case, the kit is readily taken anywhere.

FIG. 3A depicts a first connector in accordance with the teachings of the present invention. The connector is formed from a thermoplastic material via plastic forming techniques such as injection molding for example. The connector includes a relatively flat unitary body 38, including a pair of rings 40 and 42 respectively. While the ring members may be substantially concentric, preferably, the ring members 40 and 42 are spaced apart along opposite ends of a spacer otherwise referred to as a linkage 44. The linkage, which preferably is relatively narrow as compared to the rings members 40 and 42, includes central portion 46, a first end 48 which attaches to the first ring member 40 and a second end 50, which attaches to the second ring member 42.

Figure 3B:
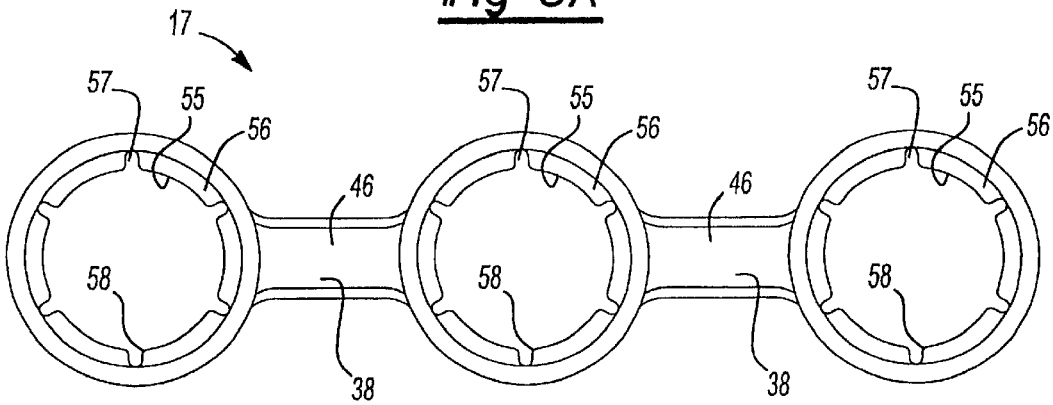
FIG. 3B is a top plan view of another embodiment of the first connector, showing its structure.
Figure 3C:
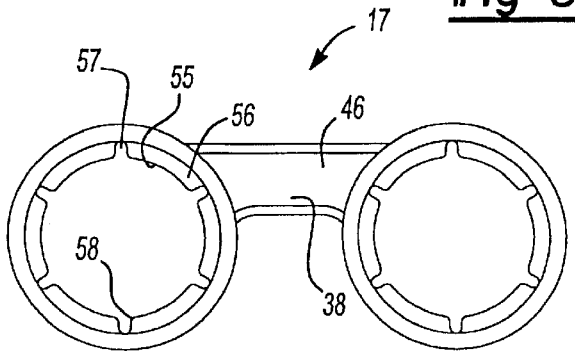
FIG. 3C is a top plan view of another embodiment of the first connector, showing its structure.
Figure 3D:
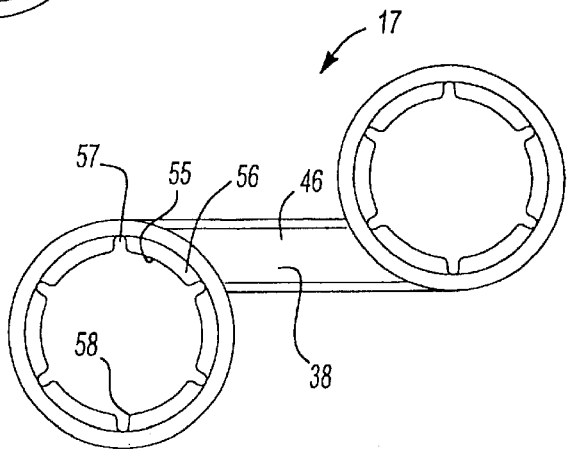
FIG. 3D is a top plan view of another embodiment of the first connector, of showing its structure.

According to the embodiment shown in FIG. 3A, when the linkage is disposed along a central axis A—A, the ends of the linkage preferably increase in width as each end approaches the corresponding ring member. This progressive widening from the central portion to each end is intended to enhance the flexibility of the connector. Optionally, the linkage may extend along the top or bottom portions of the ring portions, as seen in FIG. 3B or the ring members may extend along opposite sides of the linkage as shown in FIG. 3C.

The ring members include a built up peripheral rim 52 defining the outer diameter 54 and a substantially continuous inwardly extending fin 54 which extends from the rim 56 of the ring member. The peripheral rim is generally at least as thick as the linkage 44, and is preferably thicker to provide structural rigidity to the connector.

The fin 54 generally includes a plurality of spaced apart detents 56 to enhance the flexibility of the fin. Preferably, the detents have rounded edges 58 so as to preclude snagging. Disposed between the plurality of detents are teeth 60 for friction fit attachment to the logs.

Figure 4:
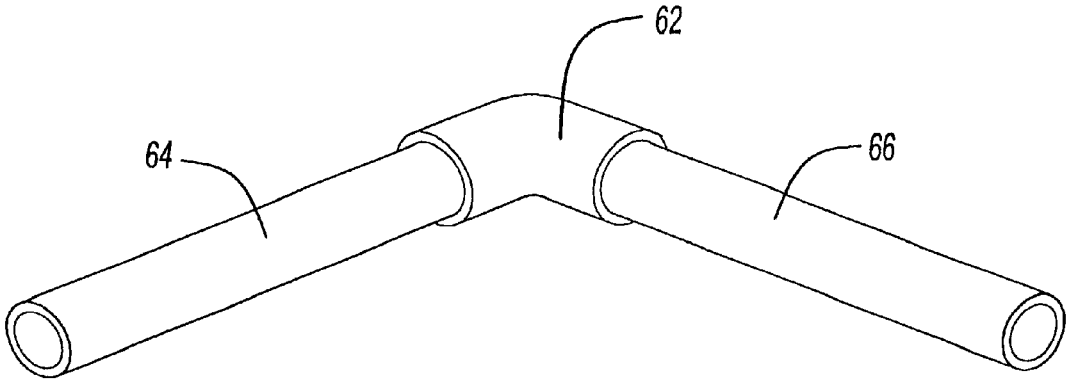
FIG. 4 is a three dimensional view of the angled connector of the present invention showing its structure.

FIG. 4 is a detailed view of the angled connectors for use in the present invention. The angled connector is comprised of a body 62, which is formed as a result of the joining of two legs 64 and 66, which are joined at any desired angle. Each leg is insertable into the openings 68 in each log, so that they may be joined to form an angled structure.

Figure 5:
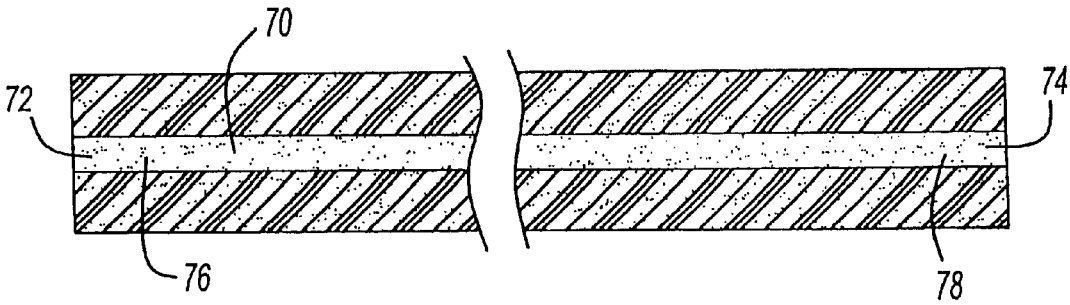
FIG. 5 is a cutaway side view of one flexible foam tube showing its structure.

FIG. 5 is a cutaway view of the logs of the present invention. Preferably, the logs and spacers are tubular and of varying lengths and colors. Each log and spacer has an axially extending passageway 70 extending lengthwise through the log. The openings 72 and 74 at either end 76 and 78 are adapted for friction fit with the angled connectors.

The closed cell foam tubes may be made of any foam material that is durable enough to be used and reused without breaking or losing its structural integrity. To this end, it is contemplated that the foam logs may be made of styrofoam, polypropylene foam, polyethylene foam or polybutylene foam material. The material should be of a closed cell structure and be flexible and weather resistant.

Most preferably, the logs and spacers are comprised of a closed cell polyethylene foam material having the formula:

$$R-O-\left[CH_2-CH_2\right]_{2n+2}-O-R$$

wherein

R is an alkyl, and n is a number such that the molecular weight of the composition is in the range of about 11,000 to about 196,000.

This material is commercially available from Industrial Thermo Polymers, Limited, located Brampton, Ontario, Canada, under the trademark Tundra Foam Logs. This material is resistant to UV light, as well as other weather conditions and is buoyant, having previously been used as flotation devices for pool use. Typically, this material presents a closed cell structure that is flexible and deformable without damage to its structure. Other similar materials that may be used are closed cell foams of polypropylene, polybutylene, or other dense closed cell foam materials.

In operation, a child inserts one end of a log into a ring of the first connectors and interposes a spacer tube between the rings and adds a second log. The process is repeated for other first connectors and spacers, until the desired structure is constructed. Then, the child inserts one end of the angled connector into the axially extending opening in the log.

While it is apparent that the preferred embodiment of the invention disclosed is well calculated to fulfill the objects stated, it will be appreciated that the invention is susceptible to modification, variation and change without departing from the scope and spirit of the claims.

I claim:

1. A building kit for making various play structures for children, comprising:

(a) at least a first set of closed cell foam tubes of a predetermined length; each said foam tube having opposing first and second ends in spaced apart relation to each other and an axial extending opening in each end extending at least partially along the length of each foam tube;

(b) at least one first connector having spaced apart apertures for receiving one or more foam apertures in a friction fit relationship; and (c) at least one angled connector having two legs joined at an apex in co planar angled relationship to each other; said legs adapted to be inserted into said apertures in said opposing ends of said foam tubes in a friction fit relationship.

2. The kit of claim 1, further including multiple sets of foam tubes, each set of said foam tubes being of different length than the other sets of foam tubes, each foam tube in each said set being of substantially the same length as other foam tubes within said set.

3. The kit of claim 1, further including spacers interposeable between said foam tubes.

4. The kit of claim 1, wherein said first connector comprises a flexible body including a first ring member having an aperture and a second member having an aperture, at least one of said apertures including one inwardly extending fin to define the inner diameter of said ring member to receive said foam tube.

5. The kit of claim 4, wherein said connector further comprises a third ring member having an aperture for receiving a foam tube in friction fit relationship.

6. The kit of claim 4, wherein said fin includes a plurality of spaced apart detents to define teeth.

7. The kit of claim 1, wherein said foam tubes are comprised of styrofoam, polyethylene, polypropylene, or polybutylene.

8. The kit of claim 7, wherein said closed cell foam tubes are comprised of a polyethylene foam material having the formula:

$$R—O—\left[CH_2—CH_2\right]_{2n+2}—O—R$$

wherein

R is an alkyl, and n is a number such that the molecular weight of the composition is in the range of about 11000 to about 196,000.

9. A kit for constructing children's play buildings, comprising:

(a) a plurality of sets of durable, lightweight, flexible, closed cell, foam tubes having a length, a width, and first and second opposing ends in spaced apart relation to each other to define a body, said length being greater than said width; each said foam tube in each said set being uniform in length; each said flexible foam tube having a passage extending axially through the length of the foam tube;

(b) at least one first connector for use in association with a flexible tube member, said first connector comprises a flexible body including a first ring member having an aperture and a second member having an aperture, at least one of said apertures including one inwardly extending fin to define the inner diameter of said ring member to receive said foam tube in a friction fit; and (c) at least one angled connector for use in association with connecting said flexible tubes, said angled connector comprised of two legs at opposed angled relation to each other, each said leg insertable in said passage at either end of said flexible foam tube to provide a friction fit to connect the tubes together axially; and (d) at least one spacer interposable between said foam tubes.

10. The kit of claim 9, wherein said connector further comprises a third ring member having an aperture for receiving a foam tube in friction fit relationship.

11. The kit of claim 9, wherein said fin includes a plurality of spaced apart detents to define teeth.

12. The kit of claim 1, wherein said closed cell foam tubes are comprised of styrofoam, polyethylene, polypropylene, or polybutylene.

13. The kit of claim 9, wherein said closed cell foam tubes are comprised of a polyethylene foam material having the formula:

$$R—O—\left[CH_2—CH_2\right]_{2n+2}—O—R$$

wherein

R is an alkyl, and n is a number such that the molecular weight of the composition is in the range of about 11000 to about 196,000.

* * * * *